United States Patent [19]

Kellison

[11] Patent Number: 4,875,808

[45] Date of Patent: Oct. 24, 1989

[54] SEISMIC ANCHOR

[76] Inventor: Roger C. Kellison, 8200 Blvd. East, North Bergen, N.J. 07047

[21] Appl. No.: 181,655

[22] Filed: Apr. 14, 1988

[51] Int. Cl.[4] ..... E02D 5/74

[52] U.S. Cl. ..... 405/244; 52/170; 52/298; 405/229

[58] Field of Search ..... 405/244, 259, 260, 261, 405/258; 52/98, 99, 297, 298, 296, 167, 170; 404/10, 11

[56] References Cited

U.S. PATENT DOCUMENTS

| | | | |
|---|---|---|---|
| 1,867,811 | 7/1932 | Conser | 404/11 |
| 2,554,288 | 5/1951 | Ainsley | 52/298 X |
| 3,034,606 | 5/1962 | Wiegand | 52/98 X |
| 3,193,059 | 7/1965 | Wallerstein | 52/297 |
| 3,403,520 | 10/1968 | Goodman | 52/170 X |
| 3,564,859 | 2/1971 | Goodman | 52/170 X |
| 4,105,350 | 8/1978 | O'Donnell | 52/98 X |
| 4,305,687 | 12/1981 | Parker | 405/260 |
| 4,486,117 | 12/1984 | Blau | 404/10 |

FOREIGN PATENT DOCUMENTS

| | | | |
|---|---|---|---|
| 616966 | 2/1961 | Italy | 52/298 |

*Primary Examiner*—Dennis L. Taylor

*Attorney, Agent, or Firm*—Brumbaugh, Graves, Donohue & Raymond

[57] ABSTRACT

A seismic anchor has a head for location in a hole in ground-connected structure and a shaft connected thereto to extend out of the hole and mount members or equipment to be isolated from vibrations. The head is surrounded by vibration damping means, such as a high durometer rubber or rubber-like material. A covering extends along the shaft to the damping means. Solidified bonding agent in the hole, above the head and the vibration damping means, secures the anchor in place while the sleeve prevents the bonding agent hardening to the shaft and preventing relative vibration between the ground-connected structure and the shaft.

13 Claims, 1 Drawing Sheet

SEISMIC ANCHOR

BACKGROUND OF THE INVENTION

This invention relates to vibration isolating or "seismic" anchor and more particularly to an anchor with vibration absorbent features adapted for use in supporting structure with a bonding agent retaining the anchor in place.

Various vibration damping support mechanisms for isolating buildings or equipment from seismic disturbances are known in the art. However, these have not been adapted for easily being dropped into place in a hole in supporting structure and retained there by a hardening bonding agent.

Anchors that have utilized bonding agents to fix them in place, have, on the other hand been rigidly affixed to the supporting structure without being able to damp seismic vibrations caused by earthquakes.

SUMMARY OF THE INVENTION

In accordance with this invention, a seismic anchor system has a shaft for location extending into a hole in ground-connected structure, vibration damping provisions, a means that facilitates movement of ground-connected structure relative to the anchor, and a portion of the system, including a part of the shaft, to be held captive in the hole in the ground-connected structure. The shaft part held captive can be a head on the shaft, received by the vibration damping provisions. A shoulder on the vibration damping provisions is restrained from removal by a hardened securing agent.

The anchor preferably has an elongate shaft extending into the hole in the ground-connected structure and terminating in the head. A covering on the shaft, such as a plastic sleeve, segregates the shaft from bonding agent permitting relative movement therebetween. In one embodiment, a conical sleeve constitutes the covering, approaching the shaft only at the location of the vibration damping provisions. This permits increased relative lateral movement between the ground-connected structure and the anchor shaft. A lubricant can also be used to insure that the shaft of the anchor is not contacted by and affixed to the solidified bonding agent.

Several vibration damping arrangements are suitable for use in the invention. A high durometer Butyl rubber or rubber-like synthetic, encasing the head of the anchor, can define a lower pad, separating the anchor head from the hole bottom, and an annular upper portion, surrounding the head and defining the shoulder that is held captive below the hardened bonding agent. Damping provisions including a case with internal springs or a damping fluid are other possibilities for the means that is in vibration damping relation between the ground and the anchor.

In use, after a hole has been formed in the ground-connected structure, a hardening liquid bonding agent is poured into the hole, and the anchor system is inserted. The still-liquid bonding agent is displaced upwardly around the anchor through passages provided for that purpose. The bonding agent hardens above the enlarged portion of the anchor holding it captive. The covering on the shaft enables the ground, and the hardened bonding agent, to move relative to the shaft in the event of a seismic disturbance.

BRIEF DESCRIPTION OF THE DRAWINGS

The above and further features and advantages of the invention will better be understood with reference to the following detailed description of the preferred embodiments, taken in conjunction with the accompanying drawings, in which.

DETAILED DESCRIPTION OF THE PREFERRED EMBODIMENTS

Figure 1:
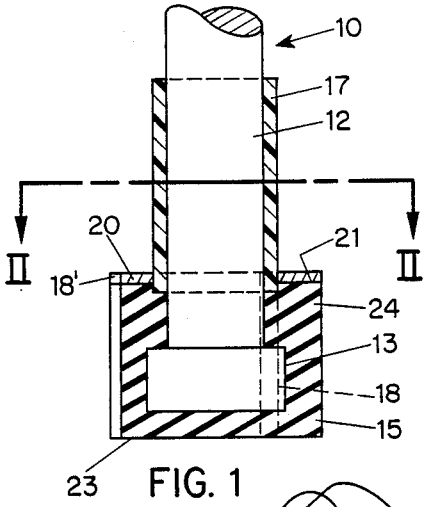
FIG. 1 a fragmentary view, partially in section, of an anchor according to the invention and showing a high durometer damping substance encasing a head of the anchor shaft, and a sleeve on the shaft to segregate the shaft from a hardening bonding agent.
Figure 2:
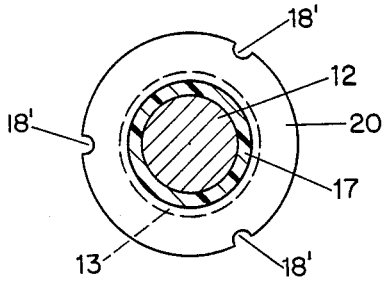
FIG. 2 is a cross-sectional view of the anchor of FIG. 1 taken along the line II—II.
Figure 3:
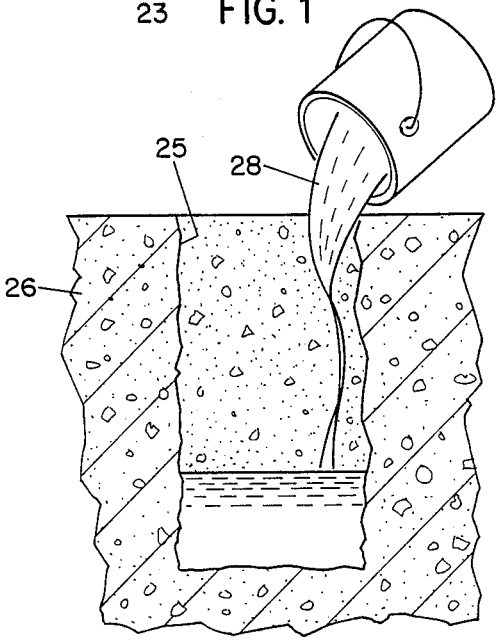
FIG. 3 is a fragmentary cross-sectional view of a holder in ground-connected supporting structure being prepared for use with the anchor of FIG. 1 by introduction of a hardening securing or bonding agent.

Turning now to FIG. 1, a vibration damping anchor system 10 has a shaft 12 terminating at its lower end in an enlarged head 13, and at its upper end in fastening provisions (not shown), suitably chosen for the structure to be secured.

A vibration damping means 15 is provided by a monolithic mass of high durometer material, such as Butyl rubber, or rubber-like synthetic material, is molded about the enlarged head 13. A covering 17 in the form of a sleeve has its lower end embedded in the material of the damping means 15, forming a liquid-tight seal around the shaft 12 from the head to the upper end of the covering 17. The material of the covering sleeve 17 is polyethylene or the like, chosen for its lubricity, so that the sleeve is able to move or vibrate relative to the shaft.

Passages 18 are formed along the length of the vibration damping mass to permit passage of liquid bonding agent therepast, as described below. A washer or steel plate 20, similarly equipped with aligned passages 18' may form the upper surface of the damping means 15, resting on an upper shoulder 21 of the damping means. From FIG. 1 it will be seen that the mass of vibration damping material that surrounds the head 13 forms a lower pad portion 23, and an annular upper portion 24 that surrounds the head and lower extent of the shaft and forms the shoulder 21. Alternatively, the pad and annular portions may be separately formed pieces applied about the head 13.

To secure the anchoring system of the invention in place, a hole 25 is formed in ground-connected structure 26. This structure can be a foundation for a building or for equipment that is to be anchored and isolated from the vibrations of earthquakes, or other vibration causing shocks or events. A predetermined quantity of solidifying bonding agent 28 is mixed and poured into the hole. The bonding agent can be a suitable, two-part commercial product such as Kelibond, available from Kelken-Gold, Inc. of 3005 Hadley Road, South Plainfield, N.J. 07080.

Figure 4:
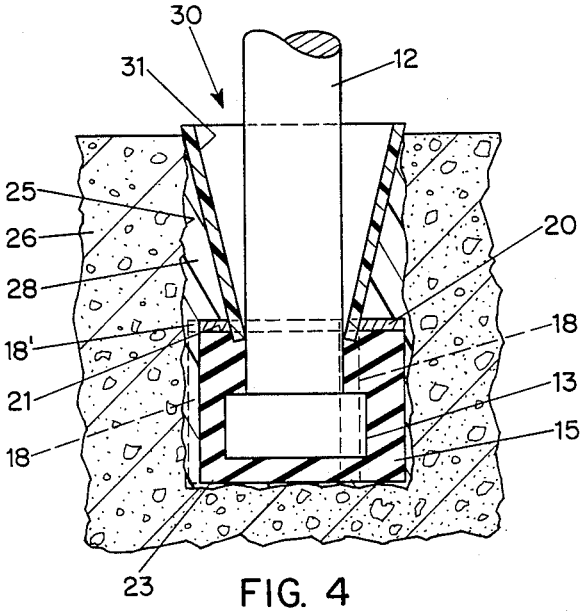
FIG. 4 is a fragmentary cross-sectional view of the hole of FIG. 3, having therein an anchor according to the invention, and shows the relationship of the anchor, hole, and hardened bonding agent.

With the still-liquid bonding agent in place, the anchor system is pushed into the hole. FIG. 4 illustrates an anchor system 30 that is like the anchor system 10 of FIG. 1, except for the conical sleeve 31 replacing the covering sleeve 17 of the FIG. 1 anchor. In FIG. 4's embodiment, similar parts are similarly numbered. The passages 18 permit the liquid bonding agent to be displaced upwardly therethrough when the anchor system 10 or 30 is pushed into the hole 25. The pad-like lower portion 23 of the vibration damping means 15 comes to rest on the bottom of the hole supporting the anchoring system. The liquid bonding agent fills in above the upper shoulder 21 of the vibration damping means forming a rigid bond to the ground connected material 26 and trapping the system in place. By virtue of the covering sleeve 17 or 31, the ground-connected structure 26 is thus able to vibrate relative to the head 13 and shaft 12.

The conical sleeve 31 of FIG. 4, because it approaches the shaft 12 only at the one location, near the top of the vibration damping means, permits for greater relative lateral movement between the ground-connected structure 26 and the upper extent of the shaft 12. If desired or necessary, the shaft can be coated as well, with a liquid impervious lubricant like the Kelken-Gold, Inc. product sold as Kelislip. This further protects against liquid bonding agent leaking or spilling into contact with the shaft 12 to connect the shaft fixedly to the structure 26.

Figure 5:
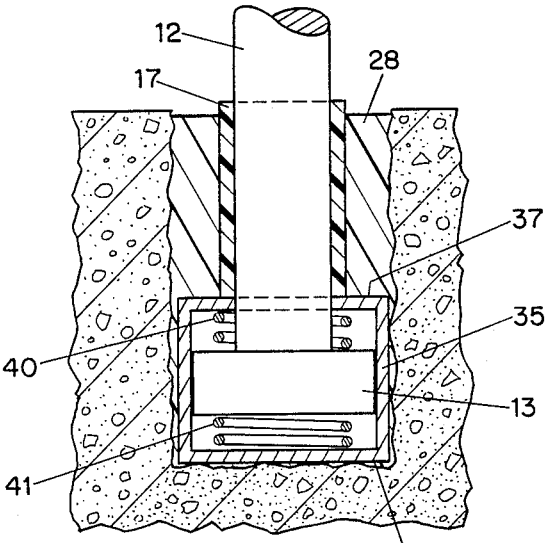
FIG. 5 is a fragmentary cross-sectional view of the hole like that of FIG. 3, and having therein a further embodiment of an anchor according to the invention including a vibration damping system of encased vibration damping springs.
Figure 6:
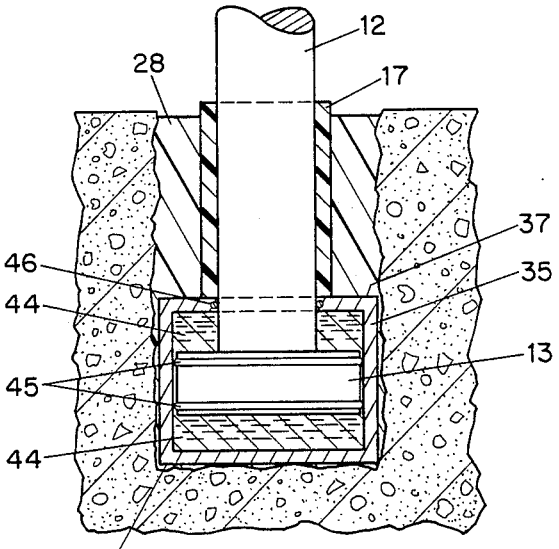
FIG. 6 is a fragmentary cross-sectional view of the hole like that of FIG. 3, and having therein a further embodiment of an anchor according to the invention including a vibration damping system of encased vibration damping fluid.

Alternative damping structures are shown in FIGS. 5 and 6. Again, like numerals denote like parts. In both figures, a casing 35 houses the vibration damping media. It forms both the bottom surface 36 on which these systems rest, and the shoulder 37 engaged by the hardened bonding agent 28. In FIG. 5, the vibration damping media are upper and lower springs 40 and 41, respectively, which engage the head 13 from above and below. In FIG. 6 the medium for damping vibration is a liquid 44 filling the spaces above and below the head 13 in the case 35. Appropriately chosen seals 45 prevent leakage of the liquid past the head, and a suitable seal 46 prevents leakage of the liquid from within the casing 35 past the shaft 12. Other vibration damping means may be employed in the system according to the invention.

While the above embodiments have been described with specific features utilized, it will be understood by those skilled in the art that modification may be made without departure from the spirit and scope of the invention as set out in the appended claims.

I claim:

1. A vibration damping anchor system including:

an elongate shaft, an enlarged head on said shaft, vibration damping means surrounding the head and preventing the head from resting against the bottom or sides of an opening receiving the anchor system, and means for covering a length of said elongate shaft and extending away from the vibration damping means to permit movement of the shaft therein.

2. A vibration damping anchor system according to claim 1, wherein the vibration damping means defines:

an end surface for resting against the bottom of an opening receiving the anchor system; and a shoulder for holding the head captive within the damping means, said damping means being secured within said opening by a hardened bonding agent in the opening bonded around the shaft and said damping means.

3. A vibration damping anchor system according to claim 2 wherein the means for covering the length of said elongate shaft is a sleeve extending along the shaft.

4. A vibration damping anchor system according to claim 2 wherein the sleeve is of lubricious plastic in sealed engagement with the vibration damping means to prevent liquid bonding agent engaging the shaft.

5. A vibration damping anchor system according to claim 3, wherein said sleeve is conical, increasing in width away from the damping means.

6. A vibration damping anchor system according to claim 2 wherein the vibration damping means is at least one portion of a high durometer rubber like material having a pad section intermediate the head and the end surface, and an annular section encircling the head and extending to the shoulder.

7. A vibration damping anchor system according to claim 2 wherein the vibration damping means comprises passages formed therein to facilitate movement of liquid bonding agent therepast upon immersion of the vibrator damping means in a hole.

8. A vibration damping anchor system according to claim 2 wherein the means covering a length of the shaft includes a coating of liquid impervious lubricant.

9. A vibration damping anchor system according to claim 2 wherein the vibration damping means comprises a casing enclosing both the head and an internal liquid vibration damping medium.

10. A vibration damping anchor system including:

an elongate shaft, an enlarged head on said shaft, vibration damping means surrounding the head and preventing the head from resting against the bottom or sides of an opening receiving the anchor system, and a solidified bonding agent located in a hole, with a portion thereof intermediate the head and damping means and retaining the head and damping means captive in the hole, the damping means being in vibration isolating relation between the solidified bonding agent and the head.

11. A vibration damping anchor system according to claim 10 wherein the means covering the length of said elongate shaft is a sleeve extending from the vibration damping means to the entrance to the hole, segregating the solidified bonding agent from the shaft to permit relative motion of the bonding agent and structure defining the hole relative to the shaft.

12. A method of vibration damping, anchoring including forming a hole in ground-connected structure; introducing a liquid, hardening bonding agent into the hole; providing an anchor system having a shaft with a head, damping means surrounding both the head and end of the shaft; and a covering extending along a portion of the shaft; inserting the damping means and shaft end into the hole to displace the liquid bonding agent upward and over the damping means and into surrounding relation to the covering, whereby the damping means and shaft end are held captive by the bonding agent upon hardening with the shaft free of interconnection via the bonding agent to the ground-connected structure.

13. A vibration damping anchor system according to claim 2 wherein the vibration damping means comprises a casing enclosing the head operatively engaged with one or more springs.

* * * * *